United States Patent [19]

Bradley, Jr. et al.

[11] 3,951,725

[45] Apr. 20, 1976

[54] TWO PIECE STRIPPER FINGER FOR CORRUGATING MACHINE

[75] Inventors: Ward J. Bradley, Jr.; Willem A. Nikkel, both of Covington, Va.

[73] Assignee: Westvaco Corporation, New York, N.Y.

[22] Filed: May 21, 1975

[21] Appl. No.: 579,719

[52] U.S. Cl. ..... 156/473; 156/584; 425/369

[51] Int. Cl.[2] ..... B31F 1/26; B31F 1/28

[58] Field of Search ..... 425/363, 369, 396, 224, 425/339; 156/205, 473, 472, 471; 162/280, 281

[56] References Cited

UNITED STATES PATENTS

| | | | |
|---|---|---|---|
| 2,979,112 | 4/1961 | Wilson | 156/473 |
| 3,220,911 | 11/1965 | Werner | 156/473 |
| 3,366,527 | 1/1968 | Briney | 156/473 |
| 3,630,806 | 12/1971 | Kitajima | 156/472 |

*Primary Examiner*—Francis S. Husar
*Assistant Examiner*—Robert J. Charvat
*Attorney, Agent, or Firm*—W. Allen Marcontell; Richard L. Schmalz

[57] ABSTRACT

Corrugating machine stripper fingers are divided into two arcuate segments. Each segment is pivotally mounted. Both segments may pivot individually relative to the machine frame or one segment may be mounted relative to the machine frame and the other mounted relative to the first segment. Both segments are resiliently biased toward the respective corrugating roll surface.

8 Claims, 4 Drawing Figures

TWO PIECE STRIPPER FINGER FOR CORRUGATING MACHINE

BACKGROUND OF THE INVENTION

1. Field Of The Invention

The present invention relates to apparatus for the continuous conversion of thin web material into corrugated board. More specifically, the present invention relates to improvements in stripper fingers which strip a web from the surface of one corrugating nip roll and confine the web closely against the surface of the other corrugating roll about a portion of the circumference thereof.

2. Description Of The Prior Art

In the art of converting thin material webs such as paper to corrugated board, the length of a traveling web is pressure formed into a continuum of corrugated undulations. This forming occurs in the meshing nip between two cylindrical roller elements having fluted surfaces. The corrugation flutes of the roller surfaces extend longitudinally parallel with the roller axes and transversely of the web length. Flutes respective to each of the two roller elements mesh together like gear teeth. Consequently, a corrugation forming pressure is exerted on the web by drawing it between the meshing roll flutes.

Subsequent to forming, adhesive is applied to the crests of the web flutes and a liner or facing web is pressed thereagainst to fabricate what is known to the industry as single faced board.

Upon emerging from the corrugated forming nip, the web must be positively stripped from the fluted surface of one roller and maintained in contiguous contact with the surface of the other roller. This contiguous contact must be maintained against the natural tendency of the corrugated web to spring away from the roller surface.

To accomplish these two functions of stripping and contact maintenance, the art has utilized a series of thin crescent shaped elements called stripper fingers. Each forming nip has a plurality of stripper fingers equally spaced along the nip length approximately 2 to 4 inches apart. For each stripper finger, a thin slot is cut around the circumference of one nip roll so that the tips of the stripper fingers may project under the meshing region and form a continuous surface to guide the web away from the slotted roll and onto the other roll.

This guide surface continues around an arcuate portion of the other roll with minimal clearance between the guide surface and the roll surface flute crests to permit the web thickness to be carried therebetween. The guide surface arc continues from the corrugation forming nip to a pressure nip whereat the liner web is applied.

Since an integral strip of web is of finite length, a subsequent strip must be threaded through the machine when a previous strip is exhausted. The most convenient and expeditious technique of such threading is to lap join the leading edge of the subsequent strip with the trailing edge of the previous strip. However, this technique results in a short length of double thickness web passing between the stripper finger guide edges and the other corrugating roll surface. Since the stripper fingers are usually of light gauge, soft metal sheet stock, they will yield to accommodate the double thickness but may permanently deform in the process. Such deformation then creates additional operational problems arising from the consequence that the following single thickness of web will spring away from the respective corrugating roll surface.

SUMMARY OF THE INVENTION

These and other problems resulting from prior art stripper finger design are resolved by the present invention wherein the arc of the stripper finger crescent is divided into two, structurally integral segments. One segment is secured to a clamping structure that is pivotally mounted to the conventional machine finger mount and resiliently biased against the respective corrugating roll surface.

The other stripper finger segment is secured to second clamping structure that may also be pivotally attached to the finger mount or, alternatively, pivotally attached to the first clamping structure and resiliently biased against the respective corrugating roll surface.

The respective pivot mounts for the two finger segments are positioned to permit the maximum possible linearity in gap change relative to the respective roll surface as a finger segment is urged therefrom by a web thickness abnormality. This pivot position will normally be in the proximity of a planar extension of a mean or average chord across the arc of the respective finger segment.

BRIEF DESCRIPTION OF THE DRAWING

Relative to the drawing wherein like reference characters designate like or similar elements throughout the several fingers.

DESCRIPTION OF THE PREFERRED EMBODIMENT

Figure 1:
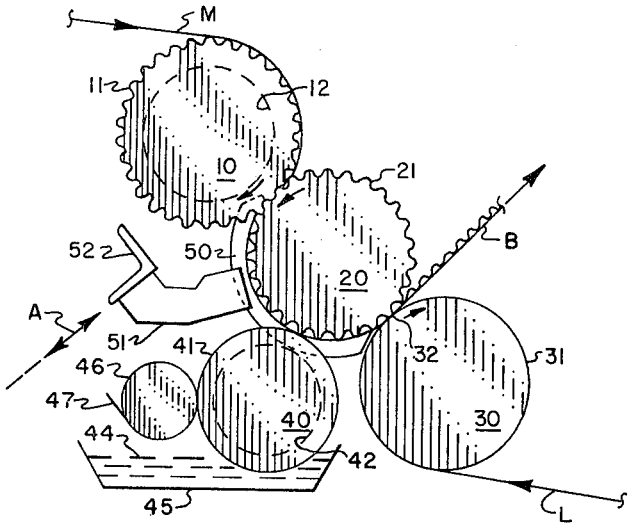
FIG. 1 PRIOR ART
FIG. 1 is a schematic illustration of a prior art single-facer station of a corrugated board fabricating machine.

The operative environment of the invention is represented by FIG. 1 which illustrates the single-facer station of a corrugated board machine.

A typical single-facer station comprises an upper corrugating roll 10, a lower corrugating roll 20 and a pressure roll 30 as the primary material forming and combining elements.

Both upper and lower corrugating rolls 10 and 20 are provided with respective, longitudinally fluted surfaces 11 and 21. These rolls are relatively positioned whereby the flute crests of one roll mesh with the flute roots of the other.

Pressure roll 30 has a smooth cylindrical surface 31 positioned relative to the locus of flute crests on the lower corrugating roll 20 whereby a pressure nip 32 is formed therebetween.

Also positioned adjacent the lower corrugating roll 20 is a glue roll 40 having a smooth or engraved surface 41. A doctor roll 46 and doctor blade 47 cooperate with the glue roll 40 to meter the quantity of adhesive allowed to remain on the glue roll following an emersive flooding of a lower secant portion of the glue roll circumference within a pool of liquid adhesive 44 contained by a glue pan 45.

Further to the prior art, as illustrated by FIG. 1, a plurality of stripper fingers 50 are positioned around a portion of the lower corrugating roll 20 circumference. These stripper fingers are laterally spaced about 2 to 4 inches apart along the corrugating roll length. A respective finger holder 51 structurally secures each finger 50 to a finger bar 52. The finger bar 52 is adjustably secured to the machine frame for movement along the plane A. For individual finger adjustment, each finger holder 51 may be adjustably secured to the finger bar 52.

For each stripper finger, a relief slot 12 and 42 is cut around the circumference of upper corrugating roll 10 and glue roll 40, respectively.

In operation, a heated web of corrugating medium M is drawn over the upper corrugating roll 10 into the flute meshing nip between corrugating rolls 10 and 20 where the web is pressure formed into a longitudinal continuum of undulations.

As the medium M emerges from the corrugating nip, it is stripped from the surface 11 of upper corrugating roll 10 by the upper tip of fingers 50 and held against the fluted surface 21 of lower corrugating roll 20 by the main body of fingers 50. Theoretically, only sufficient clearance between the flute crests of surface 21 and the proximate edge of finger 50 to accommodate the medium thickness, usually 0.009 inch to 0.010 inch, is permitted.

As the corrugated medium is carried around the arc of the lower corrugating roll 20, adhesive is wiped onto the corrugated flute crests from the surface of glue roll 40 which has a slightly slower surface speed than that of corrugating roll 20. The doctor roll regulates the adhesive layer thickness on glue roll 40 and, hence, the quantity of adhesive applied to each flute crest.

At the nip between the lower corrugating roll 20 and the pressure roll 30, a web of liner material L is pressed into intimate contact with the adhesive coated flute crests of corrugating medium M and a flow of single-faced board B emerges therefrom.

As may be envisioned by the structural geometry of the aforedescribed prior art system, a number of close tolerance dimensional settings are critical to the production of first quality product. However, difficulty in achieving such close tolerance settings is compounded by both, the lack of structural rigidity to the stripper fingers 50 and the non-linearity of the finger bar 52 adjustment mechanism.

For example, stripper fingers 50 are normally fabricated from 1/16 inch brass sheet stock having a web width of approximately ⅝ inch to ¾ inch curved about a 12 inch corrugating roll diameter. Obviously, such structure cannot withstand much structural stress without permanent deformation.

If the fingers are distorted, such as by forcing several thicknesses of medium M through the corrugator with a web splice, a certain percentage of the deformation will be permanent thereby obviating the original positionment setting. This departure will allow the corrugated medium M to spring away from the roll surface 21 resulting in an excess application of adhesive to the flute crests and deformation thereof.

Relative to non-linearity of the prior art finger adjustment mechanism, it will be noted that, because of the arc of finger curvature, a gap setting of 0.009 inch between a finger 50 edge and the flute crests of roll 20 at the bight of the finger arc will be the same at the finger tips only if the finger edge curvature is exactly concentric about the roll 20 axis for that particular radius. Consequently, there is only one theoretically correct position for a perfectly curved finger. However, if the bight gap is incorrect, the gap at the finger tip will not err by the same magnitude. In other words, the bight gap error may be great while the tip gap error is insignificant.

Figure 2:
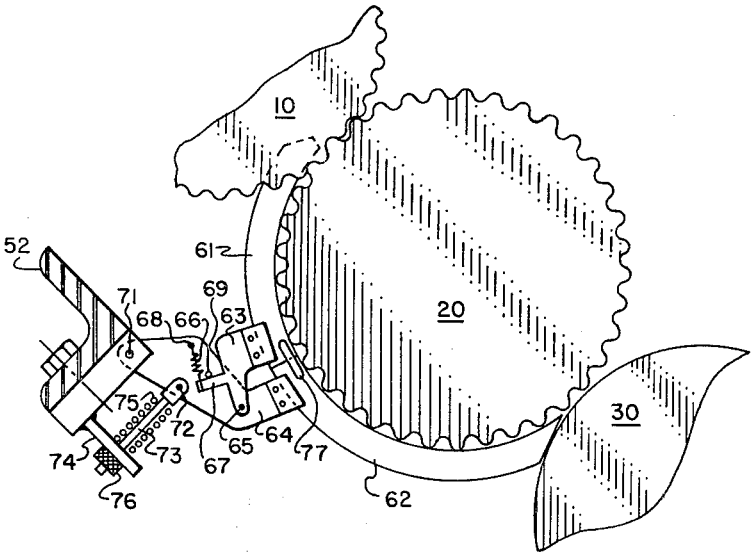
FIG. 2 is a detailed illustration of the present invention disposed in the appropriate operational position of the FIG. 1 structure.
Figure 3:
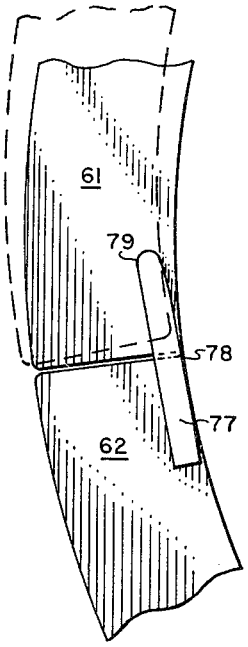
FIG. 3 is an enlarged illustration of the present invention showing the stripper finger split region.

The present invention, illustrated by the embodiment of FIGS. 2 and 3, responds to those machine adjustment difficulties arising from the prior art stripper fingers by replacing each prior art finger with a spring biased, two-piece articulated finger.

The two finger pieces 61 and 62 are secured to clamps 63 and 64, respectively. Upper finger clamp 63 is pivotally secured to the lower clamp 64 by pin journal 65. Tension spring 66 is drawn between a crank lever 67 extension of the upper clamp 63 structure and a retaining pin 68 secured to the lower clamp 64. An abutment pin 69 is also positionally secured to lower clamp 64 to engage a portion of the crank lever 67 thereby limiting the rotative freedom of clamp 63 about journal 65.

The lower clamp 64 is secured to the finger bar by a pin journal 71. An adjustable compression spring mechanism comprising a clevis journal 72 secured to a threaded rod 73 which extends through an aperture in a stop-plate 74. The stop plate is rigidly secured to the finger bar 52. A compression spring 75 biases the lower clamp 64 away from the stop-plate 74. Threaded adjustment nut 76 limits the compression spring 75 stroke.

Relative to FIG. 3, a corner shield strip 77 is secured to the lower finger half 62 flush with the flute crest engaging edge of the finger half at the finger split corner 78. A projection 79 of shield strip 77 is tapered to provide a faired edge surface between the flute crests engaging edges of finger halves 61 and 62 within the expansive limits of the two halves.

Figure 4:
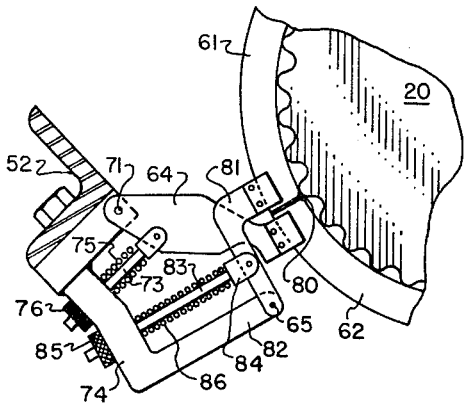
FIG. 4 is a detailed illustration of an alternative embodiment of the present invention.

Alternative to the corner shield strip 77, the finger split corner 78 may be merely chamfered as shown by FIG. 4 by reference 80. In such case, it may also be advisable to stagger the radial location of the finger split plane relative to alternately adjacent finger units.

Operatively, the split finger mechanism of the present invention is set by the clearance between the lower finger half 62 at the finger split corner 78 and the flute crests of the lower corrugating roll surface 21. This setting is achieved by a combined manipulation of finger bar 52 and the compression spring mechanism adjustment nut 76. The flute crest engaging edge of the two finger halves should be cut along a curvature concentric with the lower corrugating roll 20 rotational axis so that when the corner 78 is positioned with the correct clearance relative to the roll 20 flute crests, so too, will the remaining flute crest engaging edges of the upper and lower fingers 61 and 62.

Since the pivot axes of journals 65 and 71 respective to upper and lower finger halves 61 and 62 are reasonably close to a planar extension of a mean chord respective to the finger halves 61 and 62, only a small percentage of clearance variation will occur from tip to heel of a finger half as a finger pivots about a respective axis to accommodate a thickness irregularity in the medium web M. When the irregularity is past, both finger halves will return to the original dimensional setting under the bias of the respective springs 66 and 75.

While it is not desirable to heavily press the medium web M against the crests of fluted surface 21 by the proximate finger edges due to resultant scoring of the medium M and consequent weakness of the board B product, a light "riding" pressure will cause no difficulty. At the same time, a light riding pressure by the finger halves on the medium M will overcome the tendency of the medium to spring away from surface 21. By holding the medium firmly against the surface 21, a more uniform application of adhesive along the corrugation crests may be achieved from glue roll 40 without need to apply excessive adhesive in regions between the fingers to assure that the necessary minimum quantity is applied in regions adjacent to the fingers.

In view of these operational criteria, springs 66 and 75 are sized to permit compliance by the respective finger half before structural yield or buckling occurs.

The aforedescribed FIG. 2 embodiment of the present invention may be characterized as a floating arrangement which provides the maximum degree of stripper finger compliance freedom. The FIG. 4 embodiment of the invention does not allow the degree of compliance permitted by the FIG. 2 embodiment but in lieu thereof, permits a greater degree of structural strength and rigidity. Accordingly, a riding pressure of the finger halves against the medium M is less likely to occur.

In the FIG. 4 embodiment, the upper finger clamp 81 is pivotally secured to the finger bar 52 via an extension 82 of the stop-plate 74. The extension 82 permits the upper clamp pivot axis 65 to be placed in approximately the same location relative an average chord of upper finger half 61 as provided by the FIG. 2 embodiment. However, the axis of pivot 65 is fixedly positioned relative to the finger bar 52 rather than pivotable about the upper clamp pivot 71.

Also in the FIG. 4 embodiment, a position adjustment mechanism similar to that for the lower clamp should be provided which comprises a threaded rod 83 extending from a clevis 84 through an aperture in the stop-plate 74. A nut 85 on the threaded end of rod 83 abuts with the stop-plate 74 to provide an adjustable limit for the approach of finger 61 to the flute crests of roll 20. Coil spring 86 provides a resilient bias toward that limit.

Since use of the present invention will usually be as a substitutional replacement for prior art finger holders 51 on existing corrugating machines, the volumetric envelope of the present spring clamp will be limited substantially to that available for prior art holders 51. This, in turn, will dictate the exact location of the finger split.

Having described the presently preferred embodiment of our invention, certain modifications thereto will be obvious to those of ordinary skill in the art.

We claim:

1. In a web corrugating machine having a pair of cylindrical corrugated surface roll members mounted for rotation about respective cylinder axes and relatively positioned to rotatively mesh corrugation flute crests of one roll surface with corrugation flute roots of the other roll surface within a pressure nip region, said machine having web stripper fingers secured to finger bar means and arcuately disposed adjacent a portion of one roll cylinder circumference to strip a web drawn between the corrugated surfaces of said roll members at said nip region from the surface of the other roll and confine said web firmly against the corrugated surface of said one roll, the improvement comprising:

A. First and second stripper finger sections movable relative to each other and aligned in the same plane that is substantially perpendicular to the cylinder axis of said one roll, each section arcuately disposed in contiguous relationship to each other and adjacent a respective segment of said one roll cylinder circumference portion;

B. First finger section clamping means being rigidly secured to said first finger section and pivotally secured relative to said finger bar means;

C. Second finger section clamping means being rigidly secured to said second finger section and pivotally secured relative to said finger bar means;

D. First spring means operatively disposed against said first clamping means to resiliently bias said first finger section toward said one roll surface; and E. Second spring means operatively disposed against said second clamping means to resiliently bias said second finger section toward said one roll surface.

2. A machine as described by claim 1 comprising abutment means secured to said finger bar means to limit the compliance of at least one finger section toward said one roll surface.

3. A machine as described by claim 2 wherein said abutment means is adjustable to selectively set the limit position of at least one finger section at a desired proximity relative to said one roll surface.

4. A machine as described by claim 1 wherein the pivot of said first clamping means is positioned in the proximity of a planar extension of a mean chord to said first finger section.

5. A machine as described by claim 1 wherein the pivot of said second clamping means is positioned in the proximity of a planar extension of a mean chord to said second finger section.

6. A machine as described by claim 1 wherein the pivot of said first clamping means is secured to said finger bar means and the pivot of said second clamping means is secured to said first clamping means.

7. A machine as described by claim 6 comprising first abutment means secured to said finger bar means to limit the compliance of said first finger section toward said one roll surface.

8. A machine as described by claim 7 comprising second abutment means secured to said first clamping means to limit the compliance of said second finger section toward said one roll surface.

* * * * *